United States Patent [19]

Luo et al.

[11] 4,423,675

[45] Jan. 3, 1984

[54] MAGNETIC CIRCUIT AND PRINT HAMMER

[75] Inventors: Zong S. Luo; Chor S. Chan, both of Boise, Id.

[73] Assignee: Hewlett-Packard Company, Palo Alto, Calif.

[21] Appl. No.: 355,982

[22] Filed: Mar. 8, 1982

[51] Int. Cl.[3] ..... B41J 3/00

[52] U.S. Cl. ..... 101/93.04; 101/93.29; 101/93.48

[58] Field of Search ..... 101/93.04, 93.09, 93.29, 101/93.33, 93.34, 93.48; 335/90, 93, 94

[56] References Cited

U.S. PATENT DOCUMENTS

| | | | |
|---|---|---|---|
| 3,741,113 | 6/1973 | Mako et al. | 101/93.02 |
| 3,804,009 | 4/1974 | Blume | 101/93.48 X |
| 3,834,305 | 9/1974 | Gomi | 101/93.33 |
| 3,968,867 | 7/1976 | Stenudd | 101/93.04 X |
| 4,044,668 | 8/1977 | Barrus et al. | 101/93.48 X |
| 4,109,776 | 8/1978 | Ek et al. | 101/93.34 |
| 4,200,043 | 4/1980 | Nozaki et al. | 101/93.29 |
| 4,224,589 | 9/1980 | Tamulis | 101/93.29 X |
| 4,269,117 | 5/1981 | Lee et al. | 101/93.02 |
| 4,273,039 | 6/1981 | Luo et al. | 101/93.02 |

FOREIGN PATENT DOCUMENTS

| | | | |
|---|---|---|---|
| 55-2019 | 1/1980 | Japan | 101/93.09 |

OTHER PUBLICATIONS

IBM Technical Disclosure Bulletin by Tashjian et al., vol. 10, No. 11, "Magnet with Shunt Release", 4/68.

IBM Technical Disclosure Bulletin by Helinski, vol. 23, No. 6, "Print Hammer Element", p. 2260, 11/80.

IBM Technical Disclosure Bulletin by Malmros, 12-71, vol. 14, No. 7, "Electromagnetic Devices", pp. 2227-2229.

*Primary Examiner*—Edward M. Coven
*Assistant Examiner*—John A. Weresh
*Attorney, Agent, or Firm*—Joseph H. Smith

[57] ABSTRACT

A high-speed print hammer and magnetic actuator is provided which operates with a minimum of power dissipation, can achieve high speed, and has very little flux leakage beyond the mechanical structure. The magnetic actuator is made up of two pole pieces having a high magnetic permeability, with a permanent magnet therebetween. A print hammer, also having a portion constructed of a material with a high magnetic susceptiblity, is pulled away from its unsprung position by the permanent magnet and contacts the faces of the pole pieces, providing a very low reluctance magnetic path between them. The print hammer is released from this cocked position by a pulsed electromagnetic field applied in a direction opposite that of the permanent magnet, the pulse pattern corresponding to the desired impact pattern of the print hammer. Lower drive power to the electromagnet is achieved by providing an alternate magnetic path having a reluctance intermediate between that provided by the print hammer when it is in contact with the pole faces, and the reluctance between the pole faces (i.e., through the air) when the print hammer is not in contact with the pole faces.

20 Claims, 8 Drawing Figures

MAGNETIC CIRCUIT AND PRINT HAMMER

BACKGROUND OF THE INVENTION

Impact printing devices have been designed which utilize electromagnets or a series combination of an electromagnet and a permanent magnet to move a print wire in an impact direction. Such prior apparatus are disclosed, for example, in U.S. Pat. Nos. 3,198,306; 3,209,681; 3,210,616; 3,217,640; 3,304,858; 3,584,575; 3,592,311; 3,672,482; 3,690,431; 3,854,564; 4,273,039; and French Pat. No. 1,364,529. Most of these devices have relatively high power dissipation and are typically quite limited in speed and reliability due to attendant heat rise in operation. Furthermore, producing these devices in flexures, the most predominant mode for a multi-element print head, can cause serious problems during printing due to magnetic interactions between adjacent print stations.

BRIEF SUMMARY OF THE INVENTION

In accordance with the illustrated preferred embodiment, the present invention provides a magnetic circuit and print hammer combination which operates with a minimum of power dissipation, can achieve high speed, and has very little magnetic flux leakage beyond the mechanical structure. The magnetic circuit is made up of two pole pieces constructed of a material having a high magnetic permeability, with a permanent magnet therebetween. Each pole piece has a pole face for providing contact with a print hammer, the print hammer also having a portion constructed of a material having a high magnetic permeability. The permanent magnet provides a tractive force on the print hammer, pulling it into contact with the two pole faces, thereby providing a very low reluctance magnetic path between the pole pieces. Hence, no power is required to maintain the print hammer in this cocked position. In order to release the print hammer from its cocked position, a pulsed electromagnetic field is applied in a direction opposite to the direction of the magnetic field supplied by the permanent magnet, the pulse pattern corresponding to the desired impact pattern of the print hammer.

Lower drive power to the electromagnet and low crosstable between hammer is achieved by providing another low reluctance magnetic path with a reluctance intermediate between the reluctance of the magnetic path between the pole faces when the print hammer is in contact with the pole faces (i.e., the path through the print hammer) and the reluctance between the pole faces when the print hammer is not in contact with the pole faces (i.e., the path through the air). In a preferred embodiment of the invention, this intermediate reluctance path is provided by having a small air gap between the pole pieces opposite the pole faces.

Another feature promoting high speed is the mass distribution of the print hammer. The print hammer has four sections: a mounting end, a spring tine section, a magnetic section which is extremely stiff relative to the spring tine section on which it is mounted, and a stylus section mounted on the magnetic section for holding a stylus. Furthermore, the mass distribution of the print hammer is configured to suppress the influence of higher order modes of vibration.

DETAILED DESCRIPTION OF THE INVENTION

Figure 1:
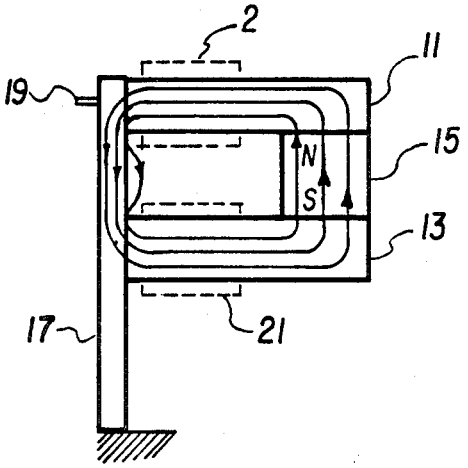
FIGURE 1 (PRIOR ART)
FIG. 1 is a diagram of a conventional prior art magnetic circuit used for printing.
Figure 2:
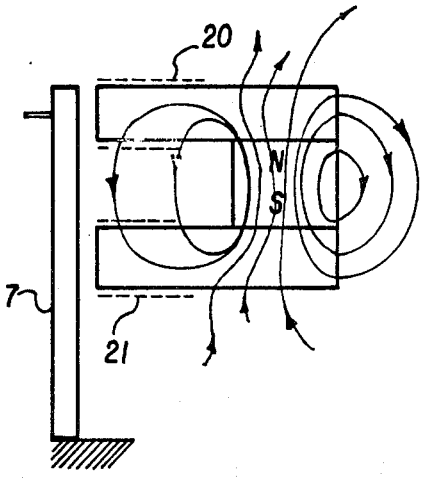
FIGURE 2 (PRIOR ART)
FIG. 2 is a diagram of the same device as in FIG. 1 showing the configuration resulting during operation.

FIGS. 1 and 2 show a typical prior art device and the associated paths of the magnetic flux. The device consists of two pole pieces 11 and 13, a permanent magnet 15 disposed between pole pieces 11 and 13, and a metallic spring tine 17 having a stylus 19 for impacting a recording medium. Spring tine 17 is attracted to pole pieces 11 and 13 from its unsprung position by the magnetic flux of permanent magnet 15. To release spring tine 17 from contact with the pole pieces, a pulsed current is provided to electromagnet coil windings 20 and 21 to create a pulsed magnetic field opposite in direction to the field provided by the permanent magnet.

FIG. 1 shows the configuration of the device with spring tine 17 in its home position, i.e., no current through coils 20 and 21. In this configuration, the path of the magnetic flux is well contained within the structure so that there is very little flux leakage. FIG. 2 corresponds to this prior art device when a current pulse has been applied to coils 20 and 21, thereby releasing spring tine 17 for impact with a recording medium. In this situation, the magnetic flux is not well contained within the structure and cross-talk between adjacent structures is very high. Furthermore, a relatively large field is required to release the tine. In repeated operation this limits the speed of the device because of problems associated with heat dissipation. Also, repeated operation as well as redriving the electromagnet tends to demagnetize permanent magnet 15.

Figure 3:
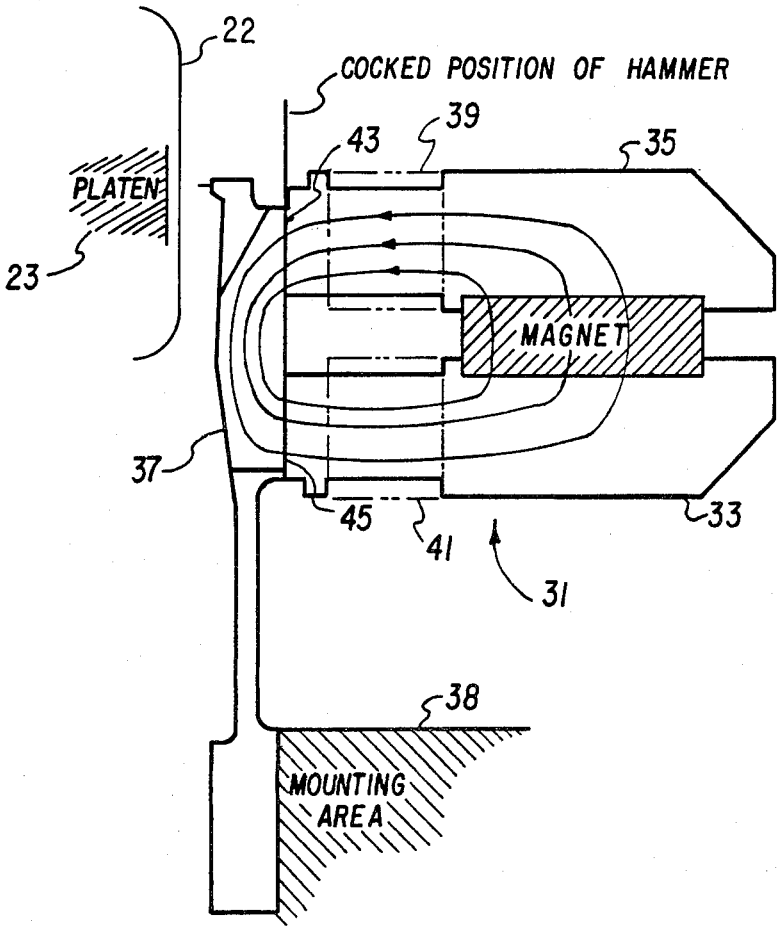
FIG. 3 shows a preferred embodiment of the invention in its home position.

All three of these problems are addressed by the instant invention. Shown in FIG. 3 is a preferred embodiment of the invention in its home position with reference to a recording medium and a platen 23. A permanent magnet 31 is disposed between two pole pieces 33 and 35 to provide a tractive force on a metallic spring print hammer 37. Print hammer 37 is mounted at its base to mounting area 38, and is maintained in its home position againt pole faces 43 and 45 by the magnetic flux from the permanent magnet. As illustrated in FIG. 3, the flux lines are well contained within the structure, print hammer 37 also acting as a keeper when in its home position. This containment of flux lines relies, of course, on having an adequate match between the magnitude of the magnetic field supplied by permanent magnet 31 and the ability of pole pieces 33 and 35 to accept that field, i.e., the pole pieces must have a sufficiently high magnetic permeability and cross sectional area so that they are not pushed beyond saturation. In this preferred embodiment, the flux at the pole face is typically in the range of 16 to 18 kilogauss and the cross sectional area of each pole face is approximately 0.78 sq. mm.

Figure 4:
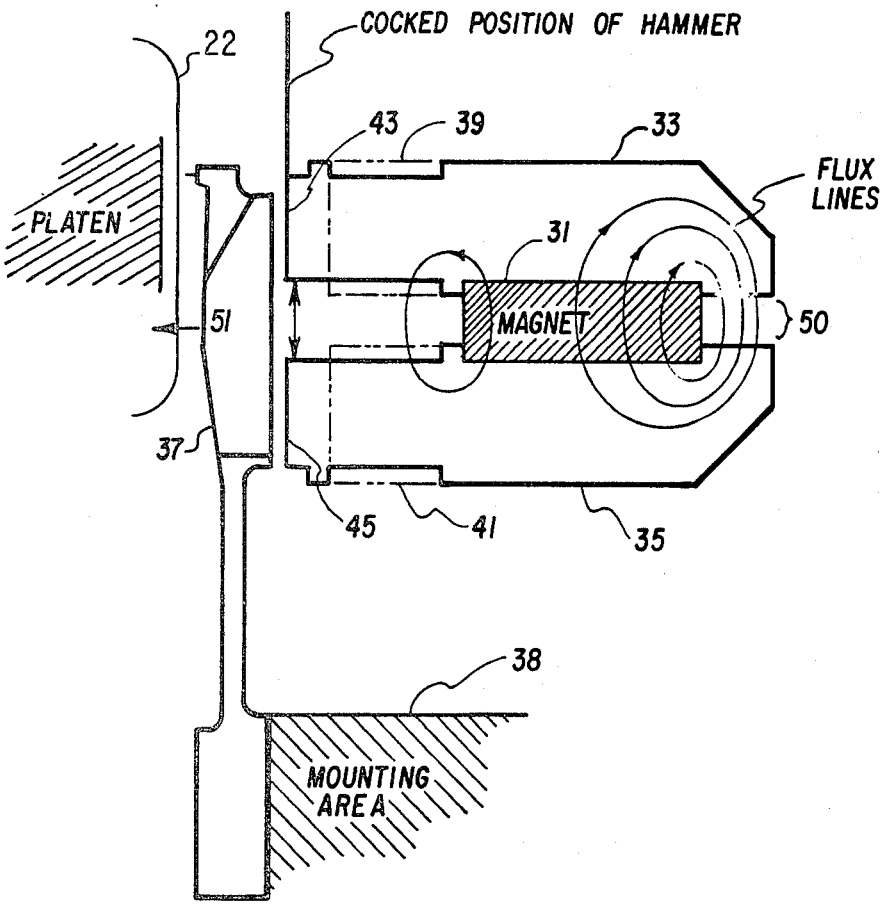
FIG. 4 shows the preferred embodiment of FIG. 3 shortly after the print hammer is released.

To print, a counteracting pulsed magnetic field is supplied by coils 39 and 41, thereby releasing print hammer 37 from its sprung (home) position in contact with pole faces 43 and 45 of pole pieces 33 and 35. This is illustrated in FIG. 4 which shows the relative motion of the print hammer shortly after release. With the coils energized, nearly all flux lines are channeled to a control gap 50, thereby significantly decreasing cross-talk between the pole pieces and any adjacent devices. Furthermore, since few flux lines extend beyond the physical structure, many such magnetic switching devices can be placed in close proximity, since magnetic cross-talk between devices will be quite small. Also, another advantage of this approach is that repeated operation as well as overdriving the electromagnet does not tend to demagnetize permanent magnet 31 as in prior art devices.

An important element of this operation is the relative reluctance of the various magnetic paths in the device. Here pole pieces 33 and 35 and print hammer 37 are made of a material having a high magnetic permeability, such as AISI-1018 steel, the print hammer being case hardened to withstand the many impacts required. Thus, in the home position, a very low reluctance path is provided, and very few flux lines extend across control gap 50 because of its considerably higher reluctance. When print hammer 37 is released, however, the reluctance along the path from pole face 42 to print hammer 37 and back to pole face 45 becomes much larger, since that path now has two air gaps. Although the pole pieces are configured such that the reluctance through control gap 50 remains higher than this path through the print hammer having two air gaps in order to preserve the self-capturing of print hammer 37 by permanent magnet 31, the difference in reluctance between these two paths becomes much less disparate. As a result, a substantial portion of the magnetic flux is switched through control gap 50 and very little flux traverses the path through the print hammer, since the net result of the vector addition of the pulsed magnetic field and the magnetic field of the permanent magnet through the print hammer is essentially zero. This is accomplished in the present embodiment by providing a suitable dimension to the width of control gap 50 (0.15 cm) which is smaller than any other distance between the pole pieces, so that the gap provides a path having a reluctance which is intermediate in value between the reluctance when the hammer is in contact with the pole faces and when it is not, i.e., the reluctance through the control gap is higher than the reluctance through the print hammer when the print hammer is in contact with the pole faces, but is lower than the reluctance between the pole pieces along path 51 when the print hammer is released.

Figure 5:
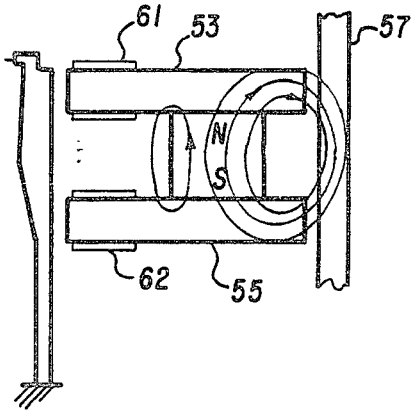
FIG. 5 shows another embodiment of the invention.
Figure 6:
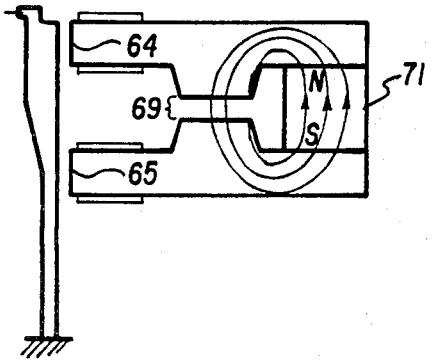
FIG. 6 shows yet another embodiment of the invention.

Clearly, having such an intermediate reluctance path can be accomplished in many different ways. In FIG. 5, for example, is an embodiment having two pole pieces 53 and 55 and two air gaps formed between a common plate 57 and the pole pieces; the static magnetic field being supplied by permanent magnet 51 and the pulsed magnetic field being supplied by coils 61 and 62. Similarly, there is no reason for air gap 50 in FIG. 3 to be on the side of the pole pieces opposite the pole faces. For example, FIG. 6 shows an embodiment with an air gap 69 between a permanent magnet 71 and pole faces 64 and 65. Finally, it is also important to realize that using an air gap is not the only available approach. The same result could be accomplished by providing intermediate magnetic susceptibility, i.e., a susceptibility which is lower than that of air but higher than that of the pole pieces and hammer.

Figure 7A:
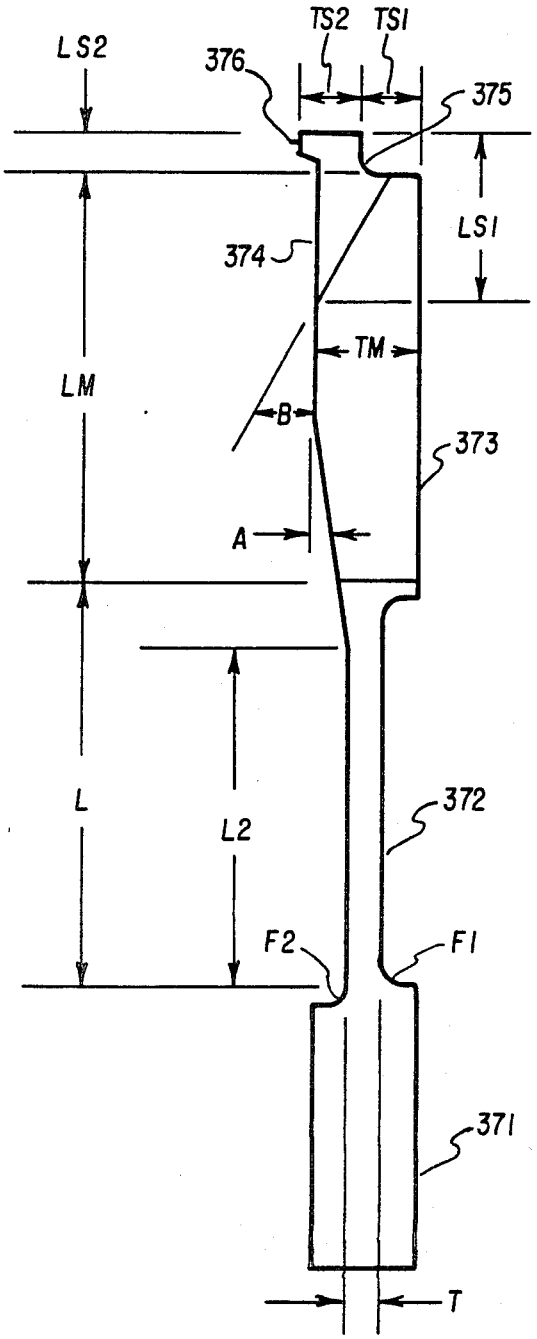
FIGS. 7A and 7B are diagrams of a print hammer particularly adapted for use in a preferred embodiment of the invention.
Figure 7B:
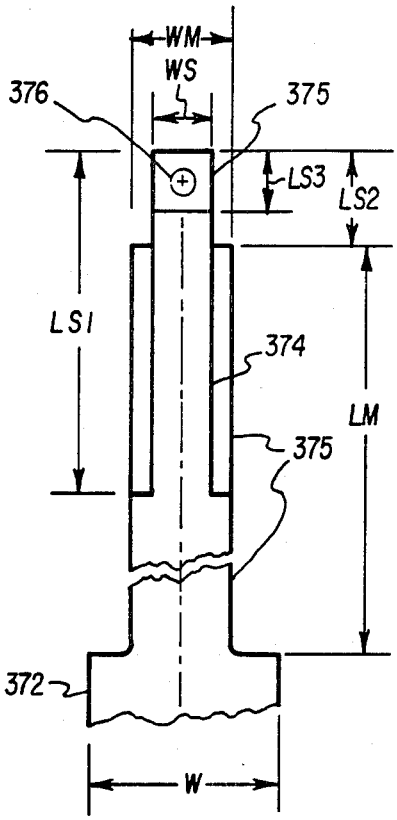

Another important feature enhancing the speed of operation of the system is the design of print hammer 37. As shown in FIGS. 7A and 7B, the print hammer is an integral element with a redistributed mass geometry. It incorporates both mechanical and magnetic properties to optimize efficiency, and is made up of primarily four sections: a mounting section 371, a spring section 372, a magnetic section 373, and a stylus section 374 holding a stylus 375. This design is quite different from prior art devices where the entire print element is primarily a prismatical leaf spring with rectangular cross section. In the present invention, spring section 372 is designed to meet the requirements of time response, energy, and reliability. Typically, spring section 372 has length L of approximately 12.2 mm, a width W of approximately 3.2 mm, and a thickness T of approximately 1.1 mm. The interface between mounting section 371 and 372 has staggered fillets, F1 and F2, to relieve the stress concentration at the interface. The interface between spring section 372 and magnetic section 373 begins at a height L2 of approximately 10.2 mm above fillet F2, and makes an angle A of approximately 9 degrees with the front face of magnetic section 373. Magnetic section 373 is designed to offer low magnetic reluctance, the contribute adequate mass for the desired print momentum, to provide a firm support for stylus section 374 and to have a high stiffness to avoid flexure (unlike spring section 372). Typical dimensions for magnetic section 373 are as follows: LM approximately 12.9 mm, WM approximately 1.7 mm, and TM approximately 3.3 mm. Stylus section 374 typically has a length LS1 of approximately 3.9 mm, a substantially uniform width WS of approximately 1.0 mm, and intersects magnetic section 373 at an angle B of approximately 30 degrees. Stylus section 374 extends a distance LS2 of approximately 1.6 mm beyond magnetic section 373, and has a substantially rectangular head 375 with a length LS3 of approximately 0.4 mm. Head 375 is bored with a hole for accepting a stylus 376 and is offset from the back side of magnetic section 373 by a distance TS1 of approximately 2.0 mm. Head 375 extends from front to back a distance TS2 of approximately 1.9 mm.

This redistributed mass geometry, in comparison with flat prismatical leaf springs, is designed to have a particular natural fundamental frequency (1157.6 Hz) in order to control forward response and to have a higher print momentum for better print impression. It also generates a higher force for the return stroke and has a high rigidity to minimize the participation of higher order dynamic modes of vibration, while at the same time the relative thickness of the flux-carrying portion (magnetic section 373) substantially decreases the magnetic interaction between adjacent print stations. The suppression of higher order dynamic modes significantly improves print quality since the stored energy in the print hammer upon releases is channeled primarily into the forward motion of the print hammer, which corresponds to its natural fundamental frequency, rather than channeling the energy into its higher order modes which may impart little if anything to the forward momentum of the hammer. As an illustration of the suppression of the influence of higher order dynamic modes, Table I provides a comparison of the ratios of the relative frequencies of the normal modes of transverse vibration in the direction of motion of print hammer 37 to those of a conventional print hammer with a uniform rectangular cross-section having the same fundamental frequency (both pinned at one end in cantilever fashion as in the preferred embodiment). (For a mathematical discussion of the transverse oscillations of a bar which is clamped at one end, see *Handbook of Physics* (E. U. Condon and H. Odishaw, 2d. ed., 1967, pages 3-107 through 3-109.) The fundamental frequency is represented by f0 (=1157.6 Hz) and the frequencies of next higher succeeding modes by f1, f2, f3, and f4. As seen from the table, the particular design of print hammer 37 results in a much better separation of the second and succeeding modes from the fundamental.

TABLE I

| FREQUENCY RATIO | f1/f0 | f2/f0 | f3/f0 | f4/f0 |
|---|---|---|---|---|
| Print Hammer 37 | 9.553 | 35.83 | 63.00 | 112.2 |
| Conventional Print Hammer | 6.268 | 17.54 | 34.35 | 56.8 |

Another particular advantage of this design is that the print element is an integral unit and is well adapted to the use of a coining process in its production, a process which is both low cost and reliable. Of course, other approaches are also available to achieve these results, e.g., using a twisted leaf spring, or using a combination of spring material and magnetic material, or perhaps even providing a welded unit of multiple parts to achieve the desired mass redistribution. Also, it is clear that this print hammer geometry can vary over a wide range depending on the desired natural frequency and impact momentum. Furthermore, the design is not restricted to a dot matrix device and could be used as well for a full character print hammer.

What is claimed is:

1. A printing device comprising:

a permanent magnet for providing a source of magnetic flux;

two pole pieces with said permanent magnet located therebetween, having a first path of low magnetic reluctance between said pole pieces; and print hammer means comprising an integral unit having two ends, one end being held fixed against transverse vibrations, said print hammer means being located in close proximity to said pole pieces for providing a second path of low magnetic reluctance between said pole pieces, said second path having a magnetic reluctance which is lower than the magnetic reluctance of said first path, said print hammer means also for switching magnetic flux from said permanent magnet between said first and second paths, and said integral unit having a frequency spectrum of normal modes for transverse vibrations such that the ratio of the frequency of the second lowest frequency mode to the frequency of the lowest frequency mode of said spectrum is greater than 7.

2. A device as in claim 1 wherein said print hammer means further comprises print means for striking a recording medium.

3. A device as in claim 1 wherein said integral unit has a ratio of the frequency of the third lowest frequency mode of said spectrum to the frequency of said lowest frequency mode greater than 18.

4. A device as in claim 3 wherein said print hammer means further comprises print means for striking a recording medium.

5. A device as in claim 3 wherein said integral unit switching means has a ratio of the frequency of the fourth lowest frequency mode of said spectrum to the frequency of said lowest frequency mode greater than 35.

6. A device as in claim 5 wherein said print hammer means comprises print means for striking a recording medium.

7. A device as in claim 5 wherein said integral unit means has a ratio of the frequency of the fifth lowest frequency mode of said spectrum to the frequency of said lowest frequency mode greater than 57.

8. A device as in claim 7 wherein said print hammer means further comprises print means for striking a recording medium.

9. A device used in a printer comprising:

print hammer means having two ends for performing transverse vibrations with one of said two ends held fixed against transverse vibrations;

print stylus means coupled to said print hammer means for impacting a recording medium as said print hammer means executes transverse vibrations;

said print hammer means and said print stylus means together having a frequency spectrum of normal modes of said transverse vibrations such that the ratio of the frequency of the second lowest frequency mode of said spectrum to the frequency of the lowest frequency mode of said spectrum is greater than 7.

10. A device as in claim 9 wherein said ratio of said second lowest frequency mode to said lowest frequency mode is substantially 10.

11. A device as in claim 9 wherein the ratio of the frequency of the third lowest frequency mode of said spectrum to said lowest frequency mode is greater than 18.

12. A device as in claim 11 wherein said ratio of said third lowest frequency mode to said lowest frequency mode is substantially 36.

13. A device as in claim 11 wherein the ratio of the frequency of the fourth lowest frequency mode of said spectrum to the frequency of said lowest frequency mode is greater than 35.

14. A device as in claim 13 wherein said ratio of said fourth lowest frequency mode to said lowest frequency mode is substantially 63.

15. A device as in claim 13 wherein the ratio of the frequency of the fifth lowest frequency mode of said spectrum to the frequency of said lowest frequency mode is greater than 57.

16. A device as in claim 15 wherein said ratio of said fifth lowest frequency mode to said lowest frequency mode is substantially 112.

17. A device as in claim 9, 11 13, or 15 wherein said print hammer means further comprises a first section having a high magnetic permeability.

18. A device as in claim 17 wherein said print hammer means further comprises a spring section.

19. A device as in claim 18 wherein said print hammer means further comprises a mounting section for mounting said print hammer means.

20. A device as in claim 19 wherein said mounting section is located at said one of two ends held fixed against transverse vibrations.

* * * * *

UNITED STATES PATENT AND TRADEMARK OFFICE

CERTIFICATE OF CORRECTION

PATENT NO. : 4,423,675

DATED : January 3, 1984

INVENTOR(S) : Zong S. Luo and Chor S. Chan

It is certified that error appears in the above–identified patent and that said Letters Patent are hereby corrected as shown below:

Claim 5, line 2, delete "switching"

Signed and Sealed this

*Twelfth* Day of *March 1985*

[SEAL]

*Attest:*

DONALD J. QUIGG

*Attesting Officer* *Acting Commissioner of Patents and Trademarks*